US009409312B2

(12) United States Patent
Gretton

(10) Patent No.: US 9,409,312 B2
(45) Date of Patent: Aug. 9, 2016

(54) DURABLE EARTHENWARE ENGRAVING PROCESS

(71) Applicant: Geoffrey Gretton, Honeoye Falls, NY (US)

(72) Inventor: Geoffrey Gretton, Honeoye Falls, NY (US)

( * ) Notice: Subject to any disclaimer, the term of this patent is extended or adjusted under 35 U.S.C. 154(b) by 369 days.

(21) Appl. No.: 14/155,242

(22) Filed: Jan. 14, 2014

(65) Prior Publication Data

US 2014/0197577 A1 Jul. 17, 2014

Related U.S. Application Data

(60) Provisional application No. 61/752,012, filed on Jan. 14, 2013.

(51) Int. Cl.

| | |
|---|---|
| ***B28B 7/34*** | (2006.01) |
| ***B28B 7/00*** | (2006.01) |
| ***B28B 11/00*** | (2006.01) |

(52) U.S. Cl.

CPC ..... *B28B 7/346* (2013.01); *B28B 7/0064* (2013.01); *B28B 7/348* (2013.01); *B28B 11/001* (2013.01)

(58) Field of Classification Search

CPC .... B28B 7/346; B28B 7/0064; B28B 11/001; B28B 7/348

See application file for complete search history.

(56) References Cited

U.S. PATENT DOCUMENTS

| | | | | | |
|---|---|---|---|---|---|
| 2,755,205 | A * | 7/1956 | Zimmerman | B05C 3/10 | 118/423 |
| 2,765,512 | A * | 10/1956 | Nesbit | B22C 9/126 | 264/28 |
| 3,561,984 | A * | 2/1971 | Eppler | C03C 4/00 | 428/428 |
| 3,641,228 | A * | 2/1972 | Fleck | B29C 33/3857 | 264/139 |
| 3,701,880 | A * | 10/1972 | Rively | B23K 26/0648 | 219/121.2 |
| 3,950,477 | A * | 4/1976 | Di Giacomo | B28B 7/007 | 264/226 |
| 4,668,521 | A | 5/1987 | Newsteder | | |
| 4,972,323 | A * | 11/1990 | Cauwet | B44B 3/009 | 358/3.29 |
| 6,511,784 | B1 * | 1/2003 | Hiller | B41C 1/05 | 430/270.1 |

* cited by examiner

*Primary Examiner* — Matthew Daniels

(74) *Attorney, Agent, or Firm* — Tracy Jong Law Firm; Tracy P. Jong; Cheng Ning Jong

(57) ABSTRACT

A method of forming a detailed image on a surface of an earthenware item is disclosed. The method comprises: (a) processing a digital image to produce an output image; (b) etching a burnable material to create peaks, valleys and indents corresponding to the output image to form a mold; (c) casting a flexible template against the mold to obtain a mirror image of the output image in the flexible template; (d) casting a surface of the earthenware in an unsintered state against the flexible template to record the output image by peaks and valleys in the surface of the earthenware item; (e) bisque firing the earthenware item in the unsintered state to render the output image permanent; and (f) applying stain to the surface of the bisque fired earthenware item and removing excess stain from of the surface of the earthenware item.

6 Claims, 16 Drawing Sheets

2

3

DURABLE EARTHENWARE ENGRAVING PROCESS

PRIORITY CLAIM AND RELATED APPLICATIONS

This non-provisional application claims the benefit of priority from provisional application U.S. Ser. No. 61/752,012 filed on Jan. 14, 2013. Said application is incorporated by reference in its entirety.

BACKGROUND OF THE INVENTION

1. The Field of the Invention

The present invention is directed generally to a process for durably engraving earthenware. More specifically, the present invention is directed to a process for durably engraving earthenware using flexible templates generated from laser etched molds on flat, curved or irregular surfaces.

2. Background Art

U.S. Pat. No. 4,668,521 to Newsteder (hereinafter Newsteder) discloses a process for transferring a halftone image into a castable material, particularly chocolate. The halftone is rendered as a textured surface where the "inked" dots of the halftone are indents in the surface of the chocolate. The image is "developed" by rubbing a contrasting colored powder, such as white confectioner's sugar, into the texture of the cast chocolate, thus filling the indents with color and making the halftone image visible.

The present disclosure extends the imaging options from just halftones to any images, art or text which can be rendered digitally from a digital image, either captured or scanned using extensive digital image manipulation tools available.

Conventional earthenware decorations currently include imprinting a pre-fired or unsintered earthenware with crude images and manual engraving of flat or curved surfaces and the like. Conventional imprinting processes produce crude "stamps" which lack depths and details typically associated with photographic images. Conventional engraving processes typical involve carving lines only onto prepared but unsintered earthenware surface. As manual depth creation is skill intensive, time consuming and therefore costly and may cause earthenware to partially harden or dry before carving work is complete, jeopardizing the workability of the earthenware materials.

Thus, there arises a need for an economical and expedient means for engraving earthenware with details and depths not previously available.

SUMMARY OF THE INVENTION

The present invention is directed toward a process for economically engraving detailed images on flat, curved or irregular surfaces of earthenware.

In one embodiment, the present method for durably engraving an earthenware item comprises:

(a) processing a digital image to produce an output image, wherein the output image comprises a plurality of pixels each having a gray level;

(b) etching a burnable material to create peaks, valleys and indents corresponding to the output image to form a mold, wherein the burnable material comprises a surface roughness;

(c) casting a flexible template against the mold to obtain a mirror image of the output image in the flexible template;

(d) casting a surface of the earthenware item in an unsintered state against the flexible template to record the output image by peaks, valleys and indents in the surface of the earthenware item;

(e) bisque firing the earthenware item in the unsintered state to render the output image permanent; and (f) applying stain to the surface of the earthenware item in the sintered state and removing excess stain from the surface of the bisque earthenware item.

In another embodiment, the present method for durably engraving an earthenware item comprises:

(a) processing a digital image to produce an output image, wherein the output image comprises a plurality of pixels each having a gray level;

(b) etching a burnable material to create peaks, valleys and indents corresponding to the output image to form a mold;

(c) casting a flexible template against the mold to obtain a mirror image of the output image in the flexible template, wherein the flexible template is constructed from an incinerable material;

(d) applying stain to the mirror image of the output image in the flexible template;

(e) engaging the mirror image of the output image of the flexible template against a surface of the earthenware item in an unsintered state to record the output image by peaks and valleys in the surface of the earthenware item; and (f) bisque firing the earthenware item in the unsintered state to render a complementary image of the mirror image of the output image of the flexible template permanent.

In yet another embodiment, the present method for durably engraving an earthenware item comprises:

(a) processing a digital image to produce an output image, wherein the output image comprises a plurality of pixels each having a gray level;

(b) etching a burnable material to create peaks, valleys and indents corresponding to the output image to form a mold;

(c) applying colorant to the mold and removing excess colorant from the mold;

(d) casting a flexible template against the mold to obtain a mirror image of the output image in the flexible template, wherein the flexible template is constructed from an incinerable material;

(e) engaging the mirror image of the output image of the flexible template against a surface of the earthenware item in an unsintered state to record the output image by peaks and valleys in the surface of the earthenware item; and (f) bisque firing the earthenware item in the unsintered state to render a complementary image of the mirror image of the output image of the flexible template permanent.

Accordingly, it is a primary object of the present invention to provide a process for economically forming detailed images and decorating such images in earthenware.

It is another object of the present invention to provide a process for economically forming three dimensional detailed images in earthenware.

It is a further object of the present invention to provide a process which incorporates mold materials which enable creation of superior detailed images in earthenware.

It is yet a further object of the present invention to provide a process which incorporates incinerable flexible template materials which are of single use and capable of being incinerated and removed while the earthenware is being sintered.

It is yet a further object of the present invention to provide a process which incorporates incinerable flexible template materials which contain image wise colorant which remains on the earthenware surface when the earthenware is sintered.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which:

FIG. 22 is a mold where a flexible template of multi-color colorants is constructed from.

FIG. 27 depicts a mold from which a color separation layer will be constructed from.

FIG. 28 depicts a mold from which a color separation layer is being constructed from.

PARTS LIST

Figure 1:
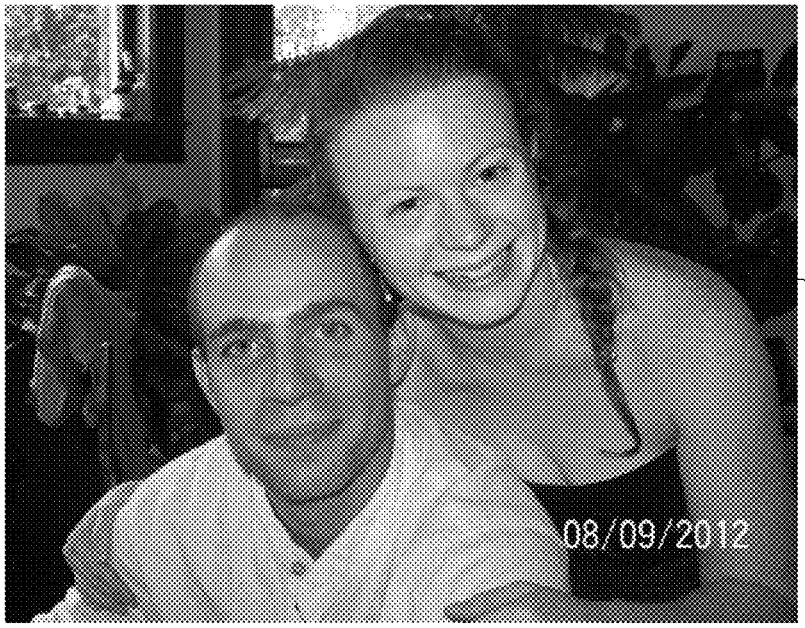
FIG. 1 depicts an original digital image obtained directly from a camera or as a result of scanning a photograph.

2—digital image
3—processed digital image
4, 4A, 4B, 4C, 4D—mold
6—flexible template
8—earthenware
10—step of processing a digital image to obtain an output file containing finished product of a plurality of pixels
12—step of etching an burnable material based on the output file to create a mold
14—step of casting flexible template from the mold

16—step of casting unsintered earthenware with flexible template
18—step of bisque firing unsintered earthenware
20—step of applying stain to bisque fired earthenware and wiping off excess stain
22—formed image
24—shape control mask
26—depth of laser ablation
28—result of laser ablation on the bottom of an indent
30—ablated layer
32—substrate
34—exposed surface of ablated layer
36—surface of substrate
38—colorant
40—peak
42—valley
44—step of applying stain to flexible template
46—indent
48—opening of shape control mask
50—colored silicone rubber
52—first color separation card
53—second color separation card
54—flexible backing upon which colored silicone rubber is adhered to
55—hole
56—first colored silicone rubber
58—second colored silicone rubber
60—third colored silicone rubber
62—colorant of first color
64—colorant of second color
66—colorant of third color
68—color separation layer or image structure, e.g., acrylic layer
69—clear acrylic
70—carrier sheet
72—registration protrusion
74—receptacle for forming registration protrusion
76—heating or heat
78—aperture
80—step of applying colorant to mold and wiping off excess colorant
82—interface layer

PARTICULAR ADVANTAGES OF THE INVENTION

The present engraving process can be applied to unsintered earthenware to create sophisticated and/or custom images on such surfaces with relative ease and without requiring the effort, skill and cost typically associated with such activity.

A mold as used in the present process is constructed from a burnable material such as Medium Density Fiberboard (MDF) or silicone rubber that is capable of recording an image with laser ablation without any deformations caused by excessive heat from laser ablation. Such a material also provides ablated portions with sufficient "tooth" such that templates of sufficient details can be cast from such mold. In contrast, a metal plate, as used in Newsteder will result in unsatisfactory "tooth" if such a plate were to be used as a mold in the present process. In addition, the surfaces of the present burnable materials are smooth, thereby preventing the recordation of imperfections on a template cast from the mold. Surface imperfections can collect colorants destined for the depressions of earthenware surfaces, creating an unclean appearance.

In one embodiment, a depth map is used to further accentuate the features of an image. Such map provides a three dimensional feel to an image cast using a flexible template corresponding to the depth map. Newsteder is not capable of such rendering as its mold making process is not capable in providing a three dimensional mold.

In one embodiment, detailed engraved color images can be faithfully reproduced on earthenware. It is well known that color images of lesser details have been manually painted or imprinted on earthenware. None of the prior art has been capable to reproduce detailed digitally generated engraved images on earthenware.

DETAILED DESCRIPTION OF A PREFERRED EMBODIMENT

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

The term "earthenware" is used herein to mean pottery manufactured with a material such as but not limited to ceramic, stoneware, bone china and porcelains, etc.

The term "tooth" is used herein to describe the surface characteristic which makes colorant particles adhere to it. In particular, the "tooth" of a present etched surface of a mold is transferred to a flexible template, which is in turn used to create an image on an earthenware item with such "tooth" for retaining colorants and the like. As an analogy, a smooth paint surface may be sanded to give it "tooth" for a second and subsequent coat of paint.

The present process to transfer a digital image onto a flat, curved or irregular surface of an earthenware item will become apparent upon reading the following description.

Obtaining an Image to be Transferred to Earthenware:

Digital images of suitable resolution that are acquired via image captures of at least about 300 pixels per inch (ppi) have been determined to be of sufficient detail for an image having a maximum dimension in the order of several inches, e.g. 5 inches. A "suitable" resolution, as used herein, is used to reference a resolution which when effected via a template on an earthenware surface, generates an image of sufficient clarity and image depth that is distinguishable from one which is imprinted on a flat surface. If acquired via digital scanning, a suitable minimum resolution should be at least 600 ppi. On a digital camera, the minimal image resolution setting of 300 ppi typically corresponds to the "high quality" setting. At a higher resolution, a digital image is capable of being processed with more sophisticated image processing techniques.

One or more image processing techniques including but not limited to accentuating image edges (to obtain sharp transitions), adjusting a pixel to a value of from 0 or 255 (black or white) depending on its gray level, converting a color to a gray level, may be applied to the digital image to result in a finished product of black line art on a white background. In one embodiment, the post processed digital images of 300 ppi in bitmap format may be provided to a laser etcher for subsequent construction of a mold. In one embodiment, the image is essentially made up of line art of black lines on a white background. In another embodiment, gray level may be rendered using the technique of halftoning. The gray levels of a halftone process are obtained by laying down a finely spaced varying size dot structure.

Figure 2:
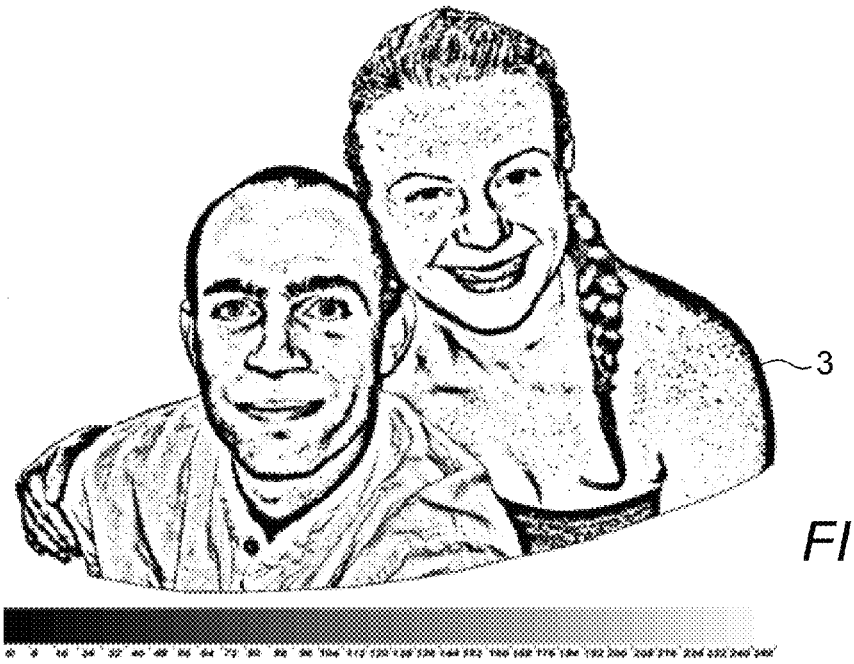
FIG. 2 depicts a line art image as a result of image processing of the image of FIG. 1 where the line art image was subsequently used to produce a mold.

FIG. 1 depicts an original digital image 2 obtained directed from a camera or as a result of scanning a photograph. It shall be noted that the digital image need not be a portrait. Any types of images may be used, ranging from simple line art, half tone images to sophisticated images of photographic quality and depth maps. The benefit of the present process is most readily realized if sophisticated images and depth maps are used as such images require tremendous amounts of labor and skill to be transferred onto earthenware. FIG. 2 depicts a line art image as a result of image processing of the image of FIG. 1 where the line art image was subsequently fed to a laser ablator to produce a mold. In this example, the size of a post processed image includes an image spanning a maximum length of about 5 inches.

In yet another embodiment, an imaging processing filter is applied to a digital image to result in a hand engraved look that is formed by black lines which are wavy and cross-hatched to obtain the gray level effect. Reference is made to a technique for converting a digital image to an engraved effect as described in the following document: http://wegraphics-.net/blog/tutorials/turn-a-photo-into-an-engraved-illustration-using-photoshop/.

Constructing a Mold:

A post processed digital image is sent to a laser etcher which subsequently etches the digital image into a burnable material. Reference is made to Epilog Laser Company's Legend Series for a suitable laser etcher. In one embodiment, Medium Density Fiberboard (MDF) is used as the mold material. The Applicant discovered several advantages of using MDF as a mold. As an MDF material is etched deeper, the bottom of each indent becomes rougher and thus offers good "tooth" to any colorant, e.g., black underglaze, which may eventually be rubbed into it. MDF is inexpensive, non-toxic when it burns and it has a hard smooth unetched surface. The laser power chosen for etching is controlled either (1) by the power level adjustment of a laser etcher or (2) by the gray level of the image written or both. However, a deeper etching provides a finished product in earthenware with more visual depth and a more obvious image-wise surface deformation and a pleasing tactile presentation. A deeper etch compromises the resolution of the image to be engraved into a surface of an earthenware item since adjoining pixels of a digital image will burn into each other. If best resolution is desired, a lower laser power is chosen to prevent excessive influence of each indent on its neighboring indents.

In other embodiments, pressed paper fiberboard, masonite and coated wall board may be used in place of MDF. In yet another embodiment, the Applicant discovered the benefits of using fine grain hardwood having a grain structure. Upon etching, the grain structure is exposed to present the look and feel of an aesthetically pleasing wood grain structure. The surface roughness of a suitable pressed paper fiberboard preferably corresponds to a grit number ranging from about 120 to about 150.

In another embodiment, writing directly into silicone rubber avoids replication steps needed to obtain a silicone rubber mold of the proper gender to mold a tool from acrylic artists paint which will subsequently be pressed into the surface of unsintered earthenware.

Figure 9:
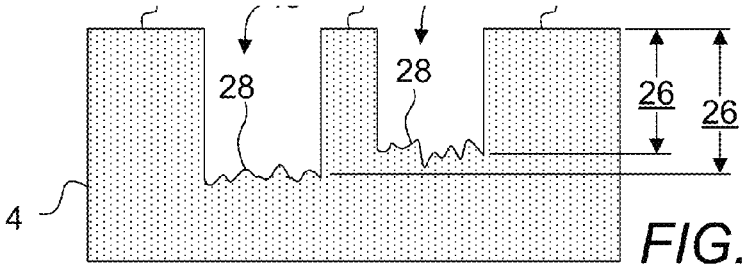
FIG. 9 is a cross-sectional view of results of the present etching step, depicting sufficient "tooth" in the indents of a portion of the mold.

FIG. 9 is a cross-sectional view of results of the present etching step, depicting sufficient "tooth" in the indents 46 of a portion of the mold 4 as a result of laser ablation. In one embodiment not shown, laser ablation is performed at uniform laser power, thereby creating indents of uniform depth. The indents 46 shown in FIG. 9 are used to demonstrate the effects of using two different laser power levels as they create indents of different depths 26. The deeper indent 46 is created at a laser power level higher than the shallower indent 46. A mold maker can then create different looks and textures as a result of varying indent 46 depths.

Figure 10:
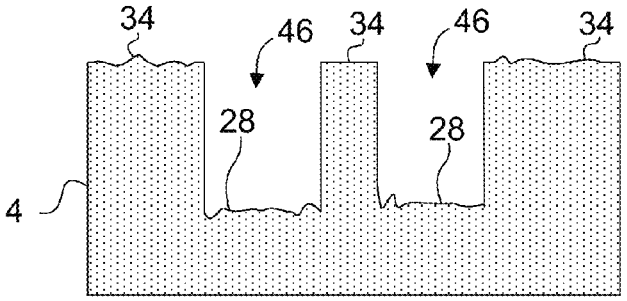
FIG. 10 is a cross-sectional view of results of the present etching step, depicting insufficient "tooth" in the indents and roughness on the surface of a portion of a mold.
Figure 11:
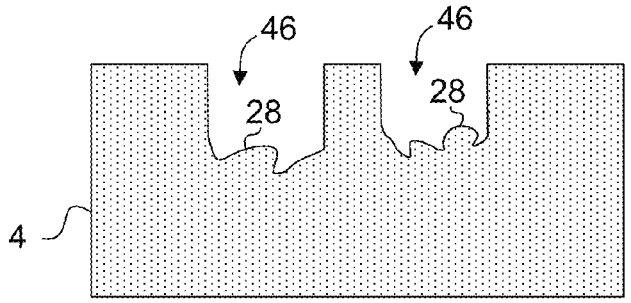
FIG. 11 is a cross-sectional view of results of the present etching step carried out on a portion of a non-burnable material, depicting the effect of melting due to laser ablation on an unsuitable mold material.

FIG. 10 is a cross-sectional view of results of the present etching step, depicting insufficient "tooth" in the indents 46 and roughness on the surface 34 of a portion of a present mold 4. Insufficient "tooth" develops as a result of the use of insufficient laser power, unsuitable material and/or non-burnable material, etc. It would not have been obvious to those skilled in the earthenware art to select a material that readily meets the criteria to provide suitable "tooth." FIG. 11 is a cross-sectional view of results of the present etching step carried out on a portion of a non-burnable and unsuitable material, e.g., acrylic plastic sheet, depicting the effects of melting and bubbling due to laser ablation. Such surfaces are neither suitable for retaining colorant particles nor are they consistent with the intended look and feel of a transferred image as melting and bubbling cause unpredictable flow of the burned materials.

Figure 12:
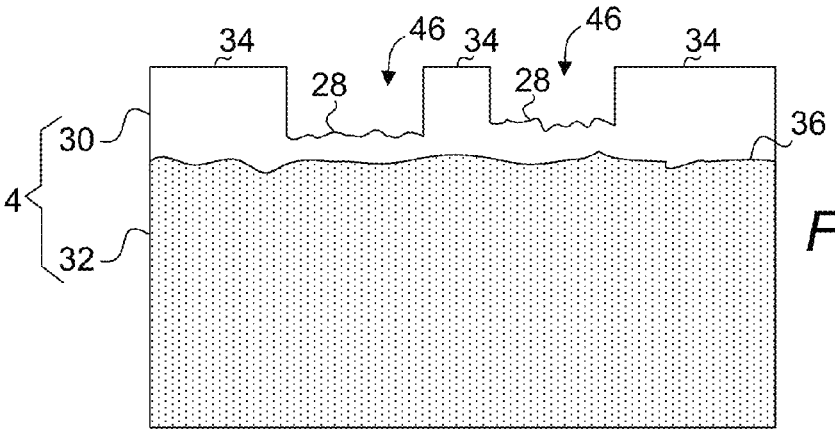
FIG. 12 is a cross-sectional view of the effects of ablating a laminate of pressed paper fiberboard bonded to a substrate.

In yet another embodiment, a laminate of pressed paper fiberboard and MDF is used in constructing a present mold. The Applicant discovered the advantages of using a material that possesses a smooth surface that is also burnable to result in sufficient "tooth." For this purpose, a layer of pressed paper fiberboard 30 is attached to the surface of a substrate, e.g., MDF 32 prior to the etching step. The substrate provides structural strength to the mold while the pressed paper fiberboard 30 constitutes a layer for recording a mirror image of a processed digital image as disclosed elsewhere herein. An exemplary pressed paper fiberboard is Blick 30-ply All-Purpose Chipboard. FIG. 12 is a cross-sectional view of the effects of ablating a laminate of pressed paper fiberboard bonded to a backing substrate. The indents 46 are solely made in the pressed paper fiberboard 30 layer, thereby leaving the surface quality of the substrate and the etching quality of the substrate unimportant. It shall be noted that the surface 36 of the substrate 32 can be unrefined and the substrate can be made of a non-burnable material.

Figure 3:
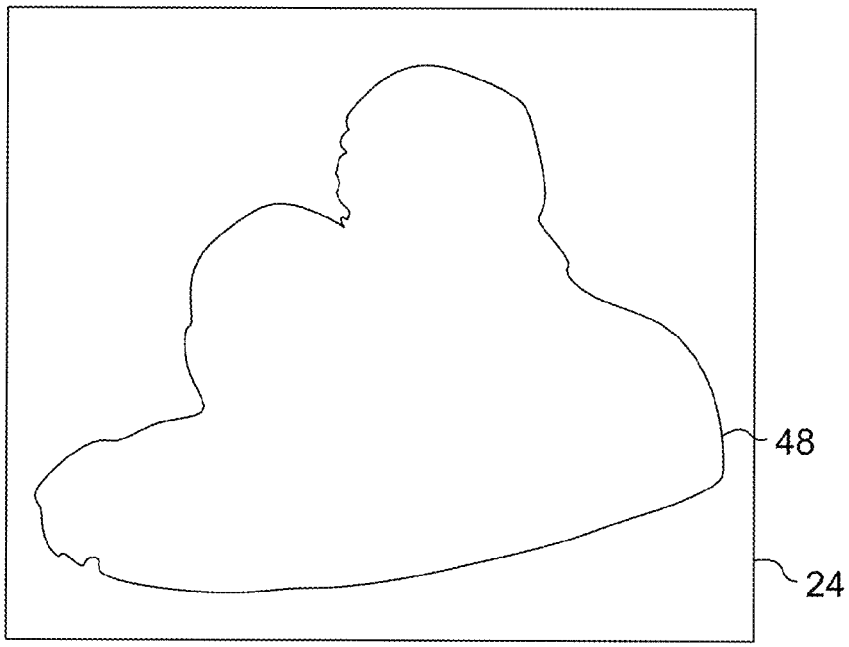
FIG. 3 depicts a shape control mask configured for aiding the construction of a flexible template.
Figure 4:
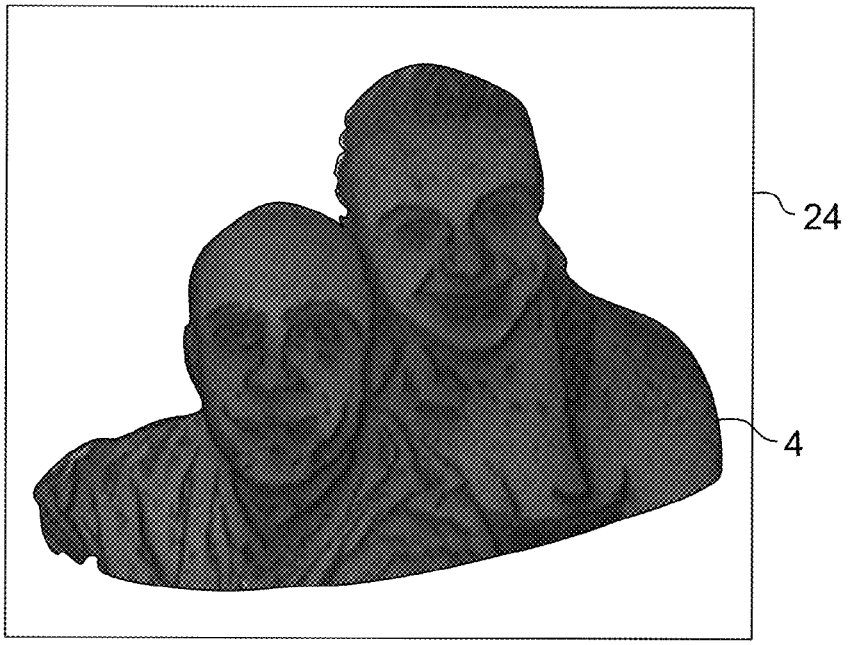
FIG. 4 depicts a present mold as a result of laser ablation.

Constructing a Flexible Template:

FIG. 3 depicts a shape control mask 24 configured for aiding in the construction of a flexible template 6. FIG. 4 depicts a present mold 4 as a result of laser ablation with a shape control mask 24 overlaid on top of the mold 4. It shall be noted that the mold 4 has been cut out from its background material (or blank) to demonstrate the image area of interest of the Applicant. Referring back to FIGS. 3 and 4, in order to construct a flexible template, a shape control mask 24 is first constructed. A shape control mask is a planar material which possesses an opening 48 in the shape of the image area of interest and when overlaid on top of the mold 4, reveals the image area of interest of the mold 4 but obscures the extraneous areas (areas surrounding the image area of interest) of the mold 4. The thickness of a flexible template to be constructed depends on the thickness of the shape control mask 24 relative to the surface of the image area of interest at the mold 4. Therefore the thicker a shape control mask 24, the thicker a resulting flexible mask will be. Although it may be possible to use another material in constructing a flexible template, silicone rubber has been discovered as a suitable material of choice as it faithfully records the image etched into the mold, is flexible for application on curved and irregular surfaces and hydrophobic to prevent swelling due to absorption of moisture while being applied on a wet earthenware surface.

Figure 5:
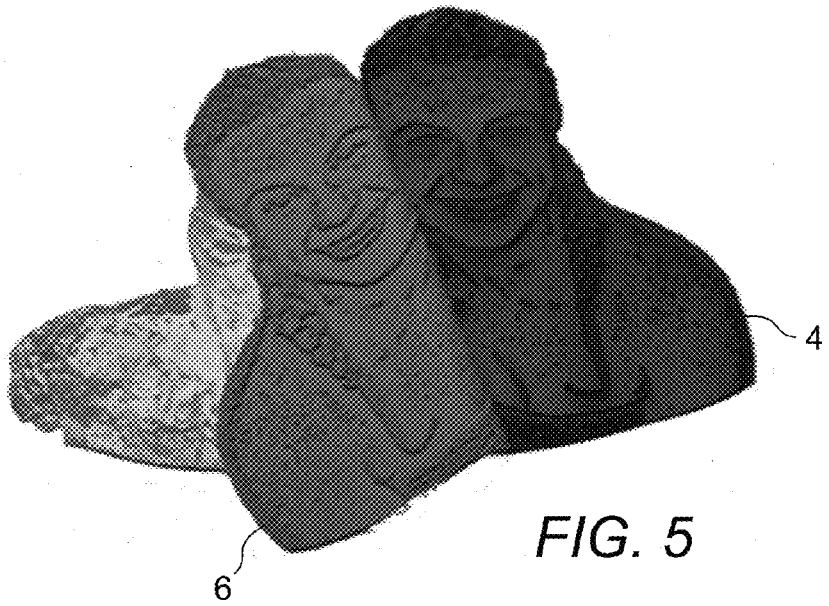
FIG. 5 depicts a cast flexible template being removed from a mold of FIG. 4.
Figure 6:
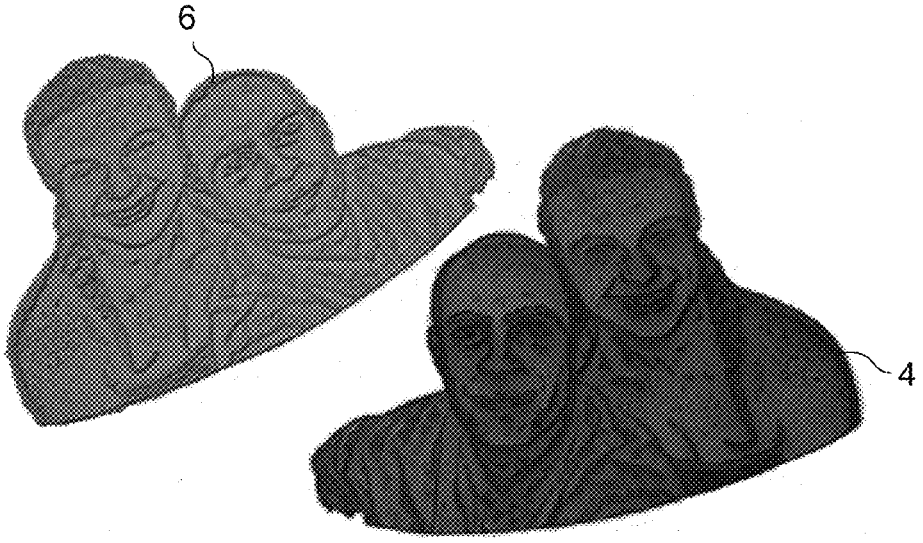
FIG. 6 depicts a cast flexible template having been removed from a mold of FIG. 4 and the transfer of the image of mold onto the image in the flexible template.

In constructing a flexible template, the etched mold 4 is first treated with a commercially available sealer and release agent. A suitable amount of two part silicone rubber is mixed and poured onto the exposed image area of interest and the surface area of the shape control mask is used as a surface to "scree" the silicone rubber to a uniform flat surface of uniform thickness and defined shape as bounded by the opening 48. In order to ensure a suitable silicone rubber mixture is obtained, an automatic mixing nozzle is used. Upon curing, the poured silicone rubber achieves a final hardness of about shore A 35 which is sufficient hardness for transferring an image from the flexible template to an earthenware item. The cast silicone rubber is peeled off or removed from the present mold 4 shown in FIG. 5. FIG. 6 depicts a cast flexible template 6 having been completely removed from the present mold 4 shown in FIG. 4 and the transfer of the image of mold 4 onto the image in the flexible template 6. It shall be noted in FIGS. 5 and 6 that the flexible template 6 is a mirror image of the mold 4. Alternatively, the flexible template 6 may be cast to include areas outside of the image area of interest and once casting is complete, the image area of interest is cut out from the flexible template.

Figure 13:
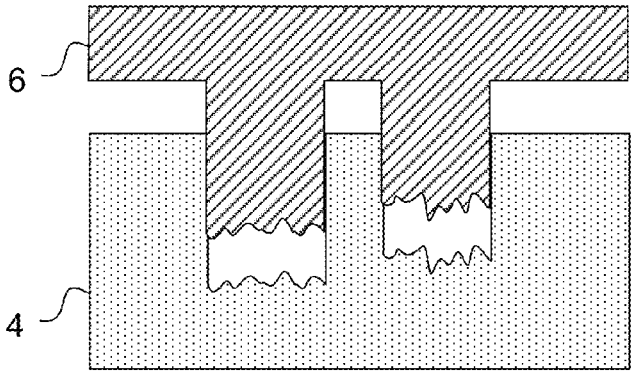
FIG. 13 is a cross-sectional view of a portion of a flexible template being removed from a portion of a mold upon being cast against a portion of a mold.
Figure 14:
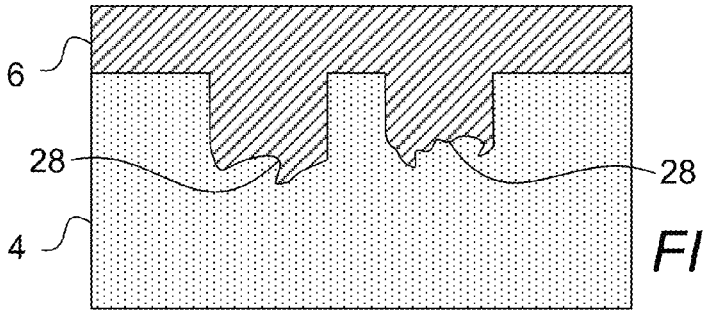
FIG. 14 is a cross-sectional view of a portion of a flexible template being cast, depicting the roughness at the bottom of ablated surfaces which pose as barrier for removal of the portion of the flexible template from a portion of a mold.

FIG. 13 is a cross-sectional view of a portion of a flexible template 6 being removed from a portion of a mold 4 upon being cast against a portion of a mold 4. FIG. 14 is a cross-sectional view of a portion of a flexible template 6 being cast, depicting the roughness at the bottom of ablated surfaces 28 of FIG. 11 which, in addition to the associated problems disclosed elsewhere herein, pose a barrier for removal of the portion of the flexible template 6 from a portion of a mold 4. It would not have been obvious to those skilled in the earthenware art to avoid selecting a non-burnable mold material, such as acrylic, in combination with laser ablation to result in suitable "tooth" for a mold.

Figure 7:
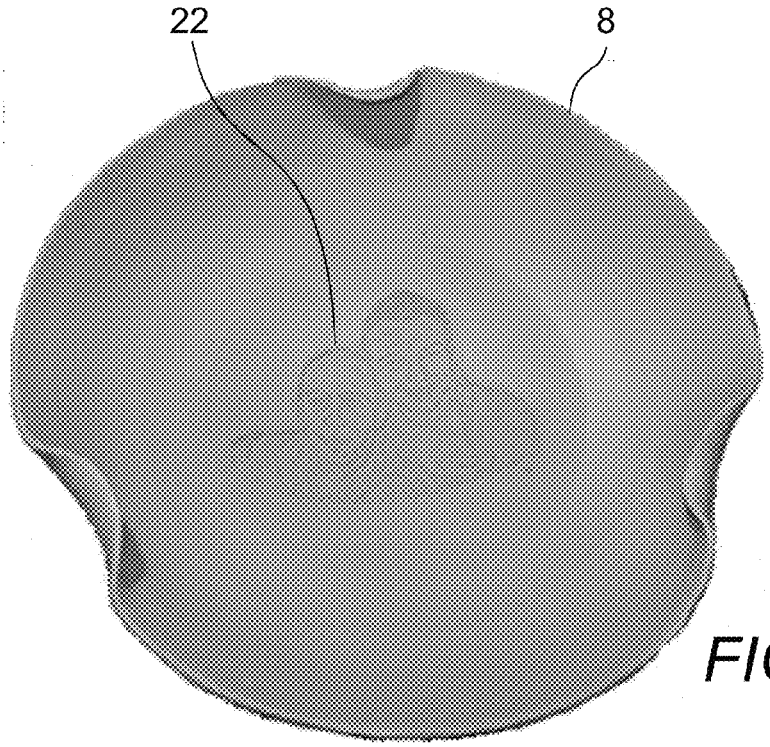
FIG. 7 depicts a sintered earthenware dish onto which the image in the flexible template has been transferred.

Transferring Image to Earthenware Surface:

A flexible template of the last step is applied to a wet flat, curved or irregular unsintered surface of an earthenware item. The portion of the flexible template bearing a desired image is pressed against the wet surface of the wet earthenware item such that the image impresses into the surface of an earthenware item to create peaks (as in a three dimensional mold), valleys (as in a three dimensional mold), exposed surfaces 34 of ablated layer and indents 46. In order to create a suitable transfer of image onto an earthenware item, the flexible template may be rubbed into place with a sponge. In one embodiment, the flexible template also serves as a protective tool to prevent the application of a decorative material such as underglaze, oxide stains, slip or the like to the surface of the earthenware item. After the surface of the earthenware item has dried, the flexible template is removed from the surface, leaving the decorative material in place, except where the flexible template covered the surface of the earthenware item. FIG. 7 depicts a sintered earthenware dish 8 onto which the image 6 of the flexible template has been transferred to form an image 22 in the earthenware dish 8.

Single Use Flexible Template

In one embodiment, a single use acrylic flexible template is used where a stain is incorporated into the image bearing surface of the flexible template. The flexible template is left on the pot during bisque firing and, therefore, making it unnecessary to apply a stain after bisque firing by rubbing a colorant into the indents and cleaning the smooth surface or peaks of formed image. A suitable single use flexible template may be constructed of a carrier sheet such as paper. In this case, the flexible template remains on the earthenware item not only during drying but during bisque firing and burns off in the kiln. Stain is first mixed into the acrylic of the first layer of acrylic applied to the silicone master. Stain concentration is somewhat dependent on the stain used but for Spectrum ceramic stain 2005 Cobalt Black in Blick Acrylic Gel Medium, about 10% by weight works well. Acrylic layers are built up and dried. When the structure is full, a very thin layer of acrylic gloss medium or other clear acrylic is painted over the image on the silicone rubber template and a sheet of newsprint or other soft, unsized paper is applied and dried. The paper with the acrylic structure adhered is then removed from the silicone rubber master. Before use, the paper is perforated from the acrylic image side with a structure of small holes. A suitable tool for this purpose is a TinkSky TS2 540-Needles Micro-needle Roller Medical Therapy Skin Care Cosmetic with 3 mm needles. When applied to wet earthenware, moisture can escape through the holes in the flexible template, aiding the drying of the earthenware. In addition to the benefits already disclosed of using paper, wetted paper better conforms to the surface shape of the earthenware.

Making Transferred Image Permanent on Earthenware:

An earthenware item is bisque fired to render the earthenware including the transferred image sintered.

Enhancing the Transferred Image:

A stain is rubbed into the indents 46 of the transferred image on an earthenware item where it colors the indents 46. The exposed surface 34 between indents 46 is wiped with a wet sponge and ends up unmarked by the stain. The earthenware item is then glazed with a clear or transparent glaze before being fired. There is an option of applying color by hand with a brush to localized areas of the transferred image thus obtaining a colored image. This works well because the color, if fairly thin with water, wicks into the indents nicely, but the process requires considerable labor.

Figure 8:
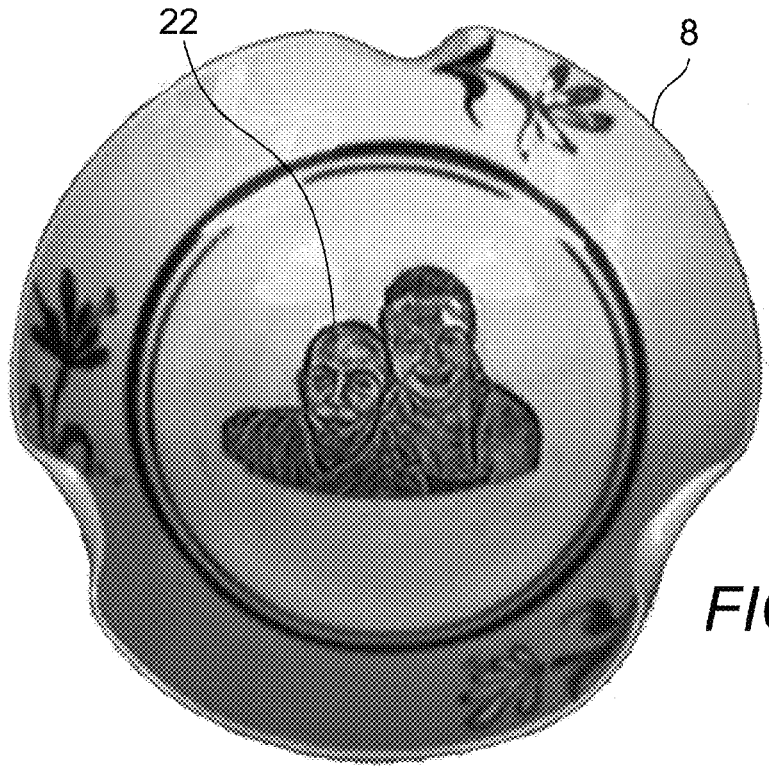
FIG. 8 depicts the earthenware dish of FIG. 7 where the dish has been sintered and the transferred image has been developed. In addition, conventional decoration by drawing has been applied, the dish has been glaze coated with a clear glaze, and glaze fired to obtain a finished dish.
Figure 15:
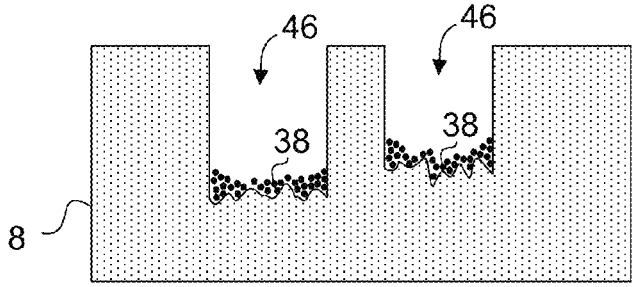
FIG. 15 is a cross-sectional view of a portion of an image that has been developed on an earthenware item.

FIG. 8 depicts the earthenware dish of FIG. 7 where the transferred image has been developed. The earthenware dish 8 of FIG. 7 becomes sufficiently hard upon sintering such that a decorative material can be rubbed into the transferred image without altering the peaks 40, valleys 42, exposed surface 34 and indents 46 corresponding to the transferred image. FIG. 15 is a cross-sectional view of a portion of an image that has been developed on an earthenware item. It shall be noted that considerable amounts of decorative material are retained in the tooth of the indents while the peaks of the earthenware item can be considerably rubbed free of decorative material, thereby creating aesthetically pleasing color contrast between the indents 46 and the exposed surface 34.

Figure 16:
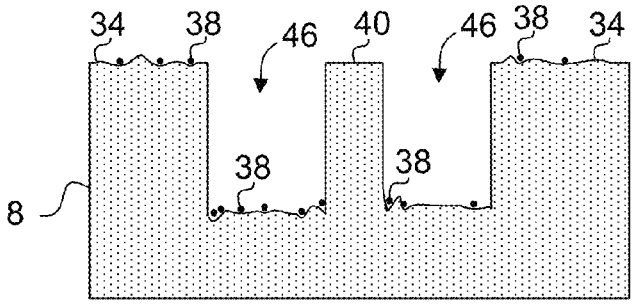
FIG. 16 is a cross-sectional view of a portion of an image that has been poorly developed on an earthenware item due to the choice of mold material which resulted in a poor flexible template.

FIG. 16 is a cross-sectional view of a portion of an image that has been poorly developed on an earthenware item due to the choice of mold (e.g., burnability) material which resulted in a poor flexible template. As a result, a non-smooth exposed surface 34 causes colorant 38 to be collected and the insufficient tooth in the valleys 42 causes colorant 38 to be sparsely retained in the valleys 42.

A Three Dimensional Mold as a Means to Enhance Transferred Image

Figure 17:
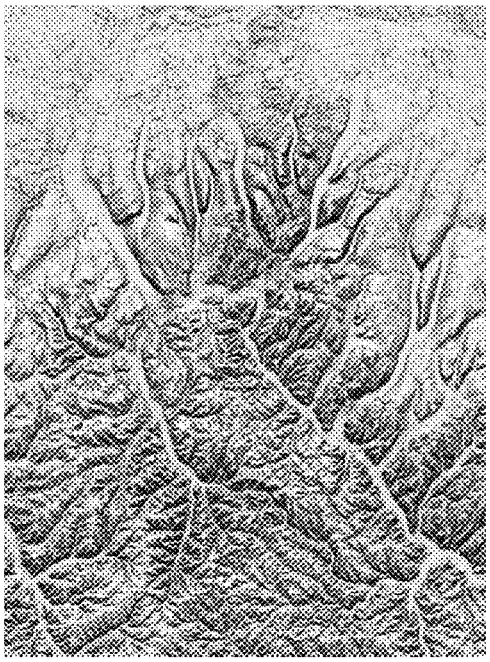
FIG. 17 is a topographical map where the shadows are cast by the terrain toward the south (or bottom of the image).
Figure 18:
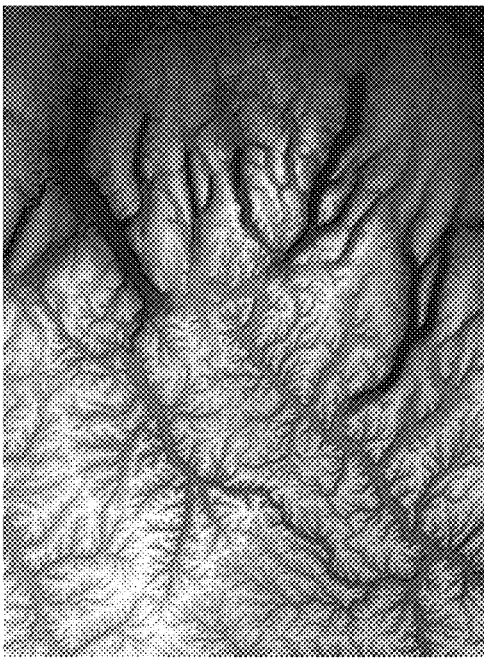
FIG. 18 is a depth map of the map depicted in FIG. 17.

Some images, e.g., topographical maps, lend themselves to three dimensional rendering of their details as information of the images is conveyed to an observer via the contours of the images. FIG. 17 is an example of a topographical map where a tremendous amount of detail can be depicted three dimensionally. As shown in FIG. 17, shadows are cast by the terrain toward the south (or bottom of the image), thereby rendering the topographical map a three dimensional feel. FIG. 18 is a depth map of the three dimensional map depicted in FIG. 17 and it contains various levels of gray which represent various elevations. In creating a mold for such an image, the laser power level is varied according to the gray level of the pixels in the depth map. In addition, surface features such as shadows, trees, roads and lakes may still be shown using indents 46 as disclosed elsewhere herein in combination with the depth map.

Figure 19:
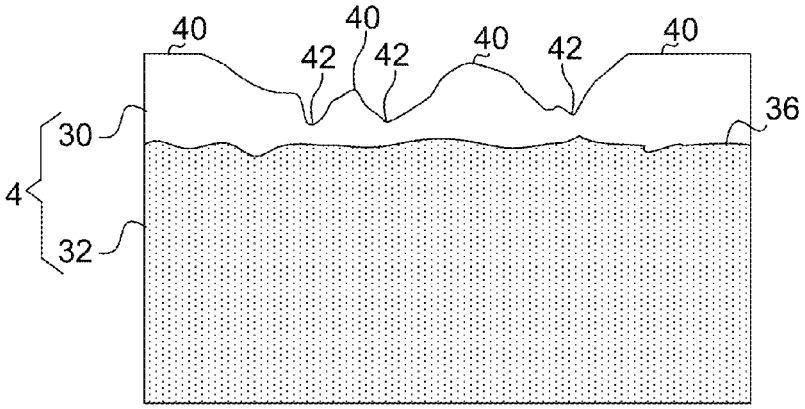
FIG. 19 is a cross-sectional view of a portion of a three dimensional mold, depicting the result of laser ablation which created peaks and valleys on the mold.

FIG. 19 is a cross-sectional view of a portion of a three dimensional mold 4, depicting the result of laser ablation which creates peaks 40 and valleys 42 on the mold 4. The Applicant discovered that minimal "tooth" that is created as a result of laser ablation is preferred in a three dimensional mold. This enables the three dimensional feel of the image to be carried through the contours of the image instead of the decorative material retained in the resulting "tooth" from laser ablation. It shall also be noted that the preferred laser ablated layer for such application is pressed paper fiberboard instead of MDF as the pressed paper fiberboard causes minimal but sufficient "tooth" and smooth surfaces.

In another embodiment, a three dimensional mold may also be constructed from the assembly of a plurality of pressed paper fiberboards with patterns already cut out or formed. Such assembly can be performed by attaching, such as spray gluing the plurality of pressed paper fiberboards. In one embodiment, the maximum thickness of a three dimensional mold ranges from about 0.1 inch to about 0.5 inch.

Incorporating a Single Colorant into a Flexible Template

This section describes a flexible template where a colorant is incorporated into the indents of the flexible template, which is embedded into a surface of an earthenware item, and is left on the earthenware item during bisque firing. It is, therefore, not necessary to "develop" the image after bisque firing by rubbing the colorant into the transferred image on the surface of the earthenware item. This flexible template would become "disposable" because the advantage of the incorporated colorant may not be realized without destroying the flexible template. This flexible template would, however, retain the versatility and elegance of the basic flexible template (without incorporated colorant). If desired, this (colored) flexible template could still be used multiple times as per the basic flexible template without taking advantage of the incorporated color. However, in transferring the single colorant, a colored flexible template that is impressed upon a surface of an earthenware item is not to be removed. During bisque firing, with the colored flexible template still attached to the earthenware item, the colored flexible template is incinerated, leaving behind the single colorant in indents of the transferred image.

In one embodiment, the colored flexible template is constructed from a mixture of silicone rubber and a colorant. Silicone rubber starts to combust at about 430 to about 450 degrees (deg) Fahrenheit (F). It continues to burn at about 750 deg F. and releases carbon dioxide and fine silicone dioxide ($SiO_2$) powder. As $SiO_2$ is a component of ceramics, the $SiO_2$ powder becomes part of the earthenware. In preparing the single colorant, it is possible to add a frit and a stain in appropriate amounts to one or both of the two components of silicone rubber such that when they are mixed in a container or in an automatic mixing dispenser, they cure into a silicone rubber with the components of a colorant mixed in the so-called colored silicone rubber.

Figure 20:
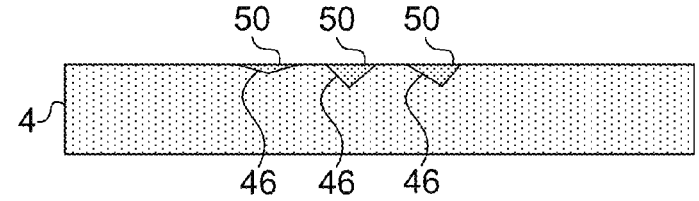
FIG. 20 is a first step of a process used for constructing a flexible template where a colorant is incorporated therein.
Figure 21:
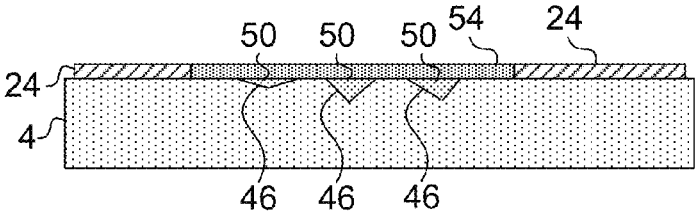
FIG. 21 is a second step of a process used for constructing a flexible template where a colorant is incorporated therein.

FIG. 20 is a first step of a process used for constructing a flexible template where a colorant 38 is incorporated therein. Colored silicone rubber is first applied to the mold and scraped off with a blade, leaving the colored silicone rubber in the indents 46 of the mold 4. For convenience, the shape control mask would not be in place such that the surface of the ablated surface can be scraped clean of the colored silicone rubber. FIG. 21 is a second step of a process used for constructing a flexible template where a colorant is incorporated therein. A shape control mask 24 is disposed atop the mold with its opening coinciding with the image area of interest. An uncolored silicone rubber is then poured onto the image area of interest and screed to be level with the shape control mask 24 to form a backing 54. Upon curing, colored silicone rubber 50 becomes bonded to the backing 54 as a unity flexible template.

During application, the flexible template can be left on an earthenware item during the drying of the item, and into the bisque firing step. In some cases, there may be a problem with keeping the flexible template in place during the drying of the item. The earthenware item shrinks several percent during drying and more during the bisque firing step to amount to a total of about 12%. As such, the tool may buckle and lose contact with the earthenware surface after drying. It is important for the flexible template to remain embedded in a surface of the earthenware item. Therefore, in one embodiment, it is advantageous to burn the flexible template off while the earthenware item is still wet or leather hard. A corner of the flexible template is accessed and ignited, e.g., with a torch. In one embodiment, a flap or tab is formed onto the non-imaged surface of the flexible template to make this access easier. As the silicone rubber burning is self-sustaining, the clear silicone rubber burns off, leaving the colorant embedded in the earthenware item. In cases where oxygen deprivation occurs, continued burning with the support of a torch may be needed.

Building, Combining and Applying Incinerable Color Separation Layers

In yet another embodiment as shown in FIGS. 27-38 and 41, there is further provided a method for durably engraving an earthenware item where color separation layers 68 are made separately and then combined to form a single flexible template before it is applied to the earthenware item. In this embodiment, the multicolored flexible template is constructed from mixtures of artist's acrylic medium and a ceramic colorant. The concentration of the colorant depends on the colorant used, but for Spectrum ceramic stain 2005 Cobalt Black in Blick Acrylic Gel Medium, about 10% by weight works well. This section describes a flexible acrylic template where an image of multiple colorants is incorporated into the indents of the flexible acrylic template, which is embedded into a surface of an earthenware item, and is left on the earthenware item during bisque firing. During bisque firing the earthenware item is incinerated with the colored flexible acrylic template still attached, leaving behind the multiple colored image in the indents of the transferred image. It shall be noted that in the drawings in FIGS. 27-38 and 41, the various layers forming the flexible templates are grossly enlarged to clearly depict the use and application of multiple layers to form such flexible templates.

Figure 27:
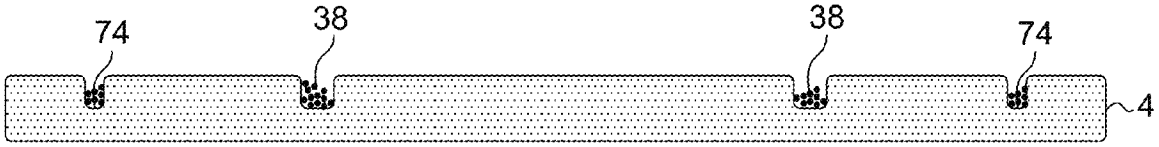

FIG. 27 depicts a mold 4 from which a color separation layer 68 will be constructed from and demonstrates a first step of a process used for constructing a flexible acrylic template where multi colorants are incorporated therein. First the color image is processed as previously described with the additional requirement that the image be split into its color components. This can be done as "spot" color or "process" color. For process color, the image color is defined as its component mixtures of four process colors. The four process colors can be either "red, green, blue, black" or "cyan, magenta, yellow, black." In either case, a separation is produced for each of the four process colors needed in the image. All colors in the image are produced by a combination of the four process colors. Although process color is possible using a flexible acrylic template, the registration challenges and color mixing challenges are considerable and further discussion will be limited to spot color.

A master or mold 4 from which a colored flexible acrylic template is cast is preferably silicone rubber, rather than MDF, as acrylic will not release from MDF. Economic advantages in using acrylic includes the following: (i) acrylic cures quicker; (ii) acrylic is cheaper than silicone rubber; and (iii) backing layer can be made thinner and is thus easier to conform to curved and irregular earthenware surfaces than silicone rubber. In addition, as acrylic is a hydrophilic material, it forms a tighter interface with wet earthenware, allowing acrylic to be applied to a wetter earthenware surface than silicone rubber. Once applied, it dries with the earthenware without falling off and when removed, a high fidelity texture cast in the surface of the earthenware results. A silicone rubber master 4 is preferably produced by laser etching directly into a silicone rubber sheet because this is the only way that the needed registration between the separate colors can be accomplished. Care must be taken to ensure that the silicone rubber sheet being etched is in an unstressed condition at the time of etching or the separate color separations will not align when the silicone rubber is brought to its unstressed condition.

Figure 28:
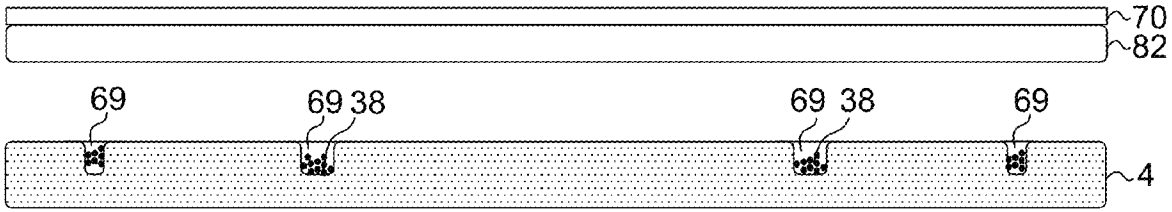

An amount of colored acrylic with colorants 38 in the form of artist's gel medium with ceramic colorant is first applied to the mold 4 by rubbing or brushing to form the first spot color. The colored acrylic is applied to the image pattern area and to the alignment feature 74. The excess is then scraped off with a blade or a wet sponge (step 80), leaving the colored acrylic with colorants 38 in the indents 46 of the mold 4 and feature 74. The colored acrylic is then dried with a warm air stream such as from a hair dryer. FIG. 28 depicts a mold 4 from which a flexible template 6 is being constructed from. An uncolored acrylic gel medium is applied to the mold 4 and scraped off with a blade or a sponge, and dried, leaving the uncolored acrylic 69 in the indents 46 of the mold, thus filling up the image texture. This step can be repeated until the image texture is sufficiently full. The colorant 38 previously disposed on the surface becomes part of the clear acrylic 69.

Figure 29:
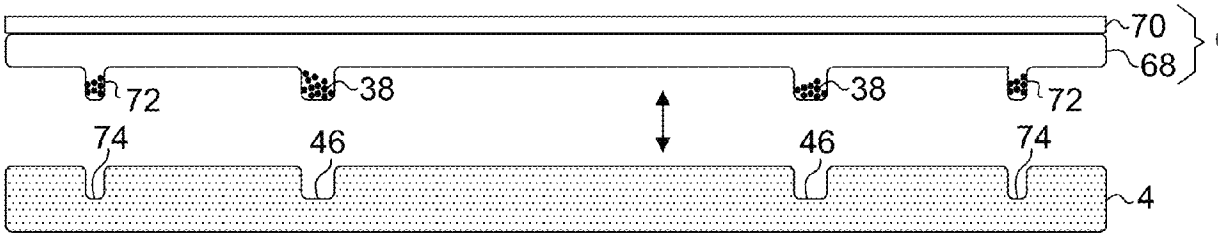
FIG. 29 depicts a newly formed flexible template is being pulled from a mold from which the flexible template was formed.

When the image structure 46 is adequately full, a carrier sheet 70 is applied. FIG. 28 shows a layer of acrylic gloss medium or other clear acrylic medium 69 is painted onto a carrier sheet 70 (e.g., newsprint or other soft, unsized paper) forming an interface layer 82. The acrylic layer should be of sufficient thickness to soften the carrier sheet 70, but excess acrylic should be avoided. The acrylic-treated carrier sheet 70 is applied to the image structure (69 and 38) on the silicone rubber master, and rubbed into the structure (e.g., with the fingers or a flexible roller such as a foam painting roller). The softened paper conforms to the image structure and ensures that the image acrylic (69 and 38) becomes bonded to the carrier sheet 70 as a unity structure over the whole image, including areas which may not be completely filled with acrylic. If a template shape is desired, the paper can be cut after the final color image is complete. The carrier sheet 70 is then dried with a heating device, e.g., hair dryer. FIG. 29 shows the carrier sheet 70 with the acrylic structure adhered removed from the silicone rubber master 4. These layers are collectively called flexible template 6.

FIG. 29 depicts a newly formed flexible template 6 that is being pulled from a mold from which the flexible template 6 was formed. It shall be noted that the colorant 38 is now part of the flexible template 6 where it was once disposed in the indents 46 of the mold 4. It shall also be noted that the portions of the flexible template 6 containing the colorant 38 are also features used to define the profile/s of the surfaces of an earthenware item on which the flexible template 6 is to be applied.

Figure 30:
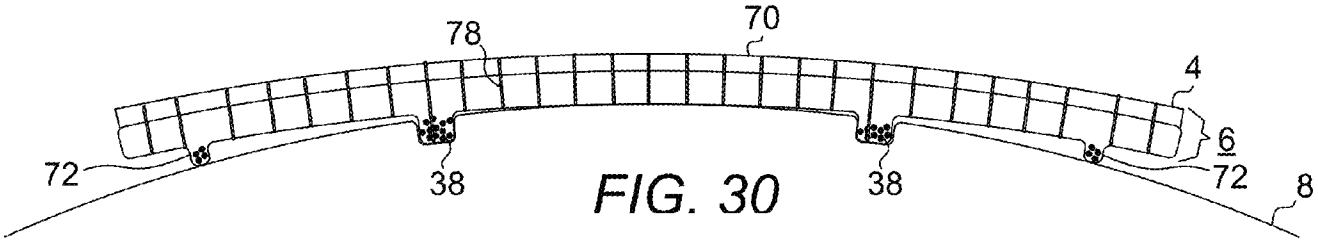
FIG. 30 depicts an earthenware surface upon which an image is being formed with the flexible template of FIG. 29.

FIG. 30 depicts an earthenware surface upon which an image is being formed with the flexible template 6 of FIG. 29. Although registration protrusions 72 are shown, they are unnecessary if only one color separation layer 68 is used as there is no need to align one color separation layer with another. Further, if a reusable flexible template made of acrylic is desired, there is no need for the ceramic colorant and the carrier sheet 70 may be used or replaced by casting a layer of clear acrylic, much like the process described for a silicone rubber flexible template. In one embodiment, the flexible template is preferably made breathable in that minute apertures 78 are formed through the flexible template allowing the flexible template to wick moisture from the earthenware surfaces, aiding the drying of the earthenware. Before use, a present flexible template is perforated from the acrylic image side with a structure of minute apertures 78 of about 0.5 mm in diameter. Piercing of the flexible template from the carrier sheet 70 side tends to cause apertures 78 to reseal, rendering such apertures 78 ineffective. A suitable tool for this purpose is a TinkSky TS2 540-Needles Micro-needle Roller Medical Therapy Skin Care Cosmetic with 3 mm needles. Also the wetted paper better conforms to the surface shape of the earthenware.

Figure 31:
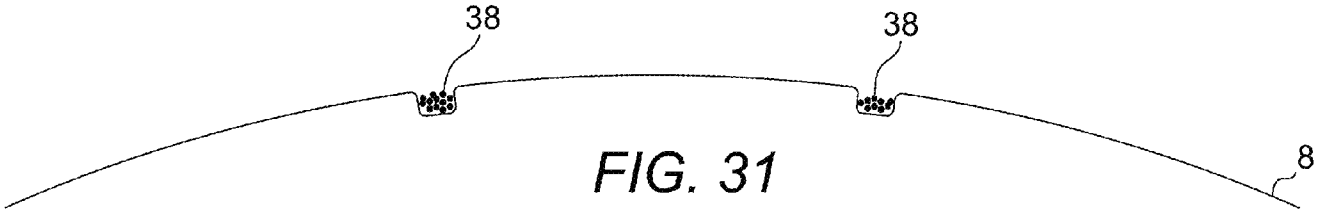
FIG. 31 depicts an earthenware surface where an image has been formed with the flexible template shown in FIG. 30.

FIG. 31 depicts an earthenware surface where an image has been formed with the flexible template 6 shown in FIG. 30. Upon bisque firing, extraneous materials, e.g., the acrylic and carrier sheet 70 are incinerated where whose ashes are easily wiped off from the cured earthenware item, leaving behind the desired surface profiles and the adhered colorant 38 from the flexible template.

Figure 32:
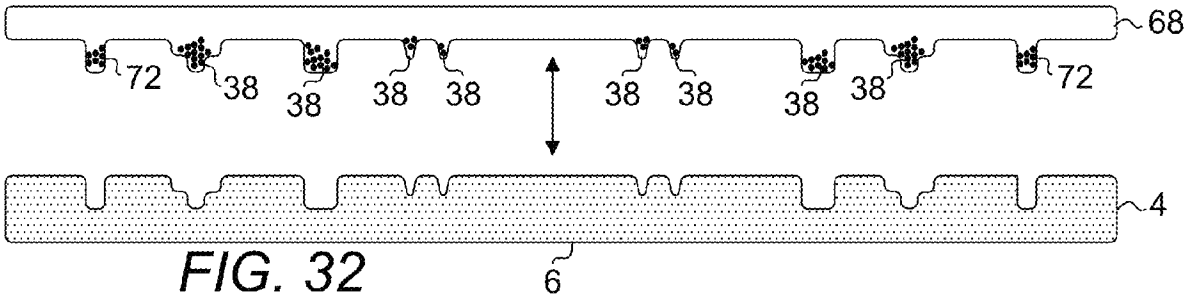
FIG. 32 depicts a scenario where colorants of the same color are used for all features of an image.
Figure 33:
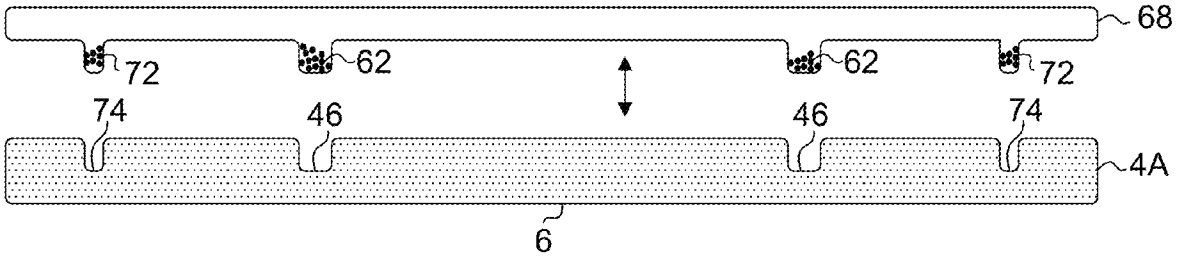
FIGS. 33 to 35 depict the construction of three color separation layers containing colorants of three different colors.
Figure 34:
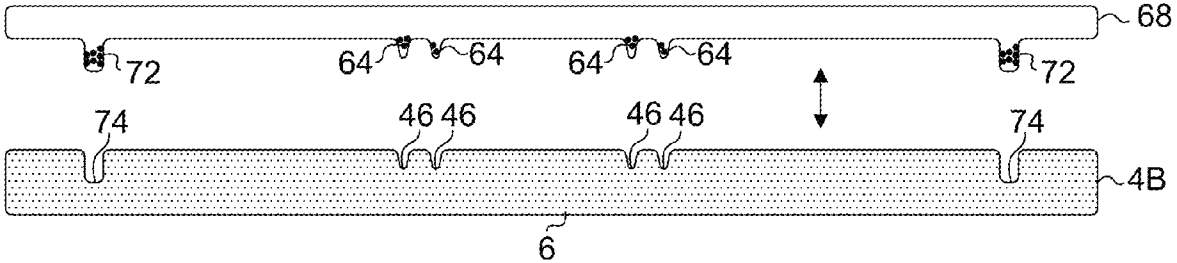
Figure 35:
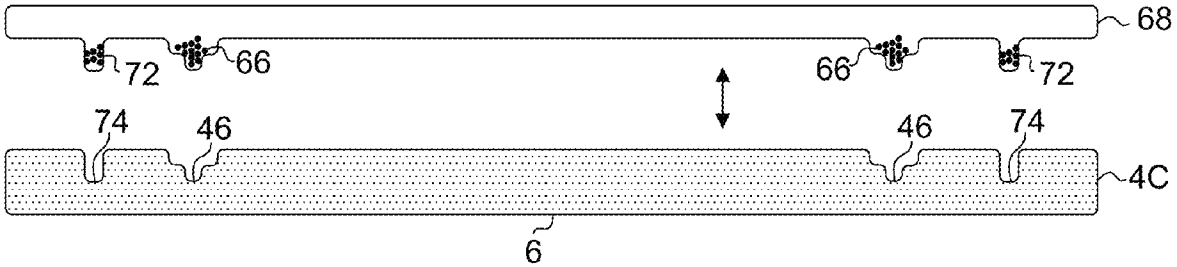

FIGS. 27-31 have demonstrated the construction and application of a colorant of just one color to an earthenware item. However, there is further disclosed a method for applying colorants of different colors simultaneously to an earthenware surface. FIG. 32 depicts a scenario where colorants 38 of the same color are used for all features of an image. A color separation layer 68 of one color is constructed where all of the colorants 38 and the features containing them are formed in a single step. However, this is not always desired and leads to the true meaning for the use of more than one color separation layer 68. FIGS. 33 to 35 depict the construction of three color separation layers containing colorants of three different colors. Three different molds 4A, 4B, 4C are formed where a colorant of a unique color is applied to each mold 4. Each mold 4 contains only the features which are applicable to the unique color intended. For spot color, separate areas of the image are defined as different colors. The image can have as many individual colors as there are spot colors defined. In this discussion, three spot colors are defined, although more are possible up to the limit of practical complexity. Also, for this discussion, a simple, easily implemented alignment technique is described. More elaborate techniques, such as those used in screen printing are possible. When the spot color areas of the image have been defined, a silicone rubber master is written for each of the spot colors 4A, 4B, 4C, and one for the whole image 4D. The receptacle 74 of the master for the whole image is written about twice as deep as for the receptacles 74 of the spot color masters. In addition, an alignment feature, such as a square box around the image, or other such feature, is written on each of the silicone rubber masters. Other suitable methods of alignment including jig construction can also be used. In one embodiment, a receptacle 74 is disposed on the mold 4 such that the flexible template can be constructed with registration protrusion/s 72 forming a square box to aid in registration of multiple color separation layers 68 as disclosed elsewhere herein.

Referring back to FIGS. 32, 33, 34 and 35, it shall be noted that the features shown in FIG. 32 is a combination of features of FIGS. 33, 34 and 35. Such features serve as collecting locations for colorants of color 62, 64 and 66, respectively. For the first spot color, the first colored acrylic of color 62 is applied to the silicone master shown in FIG. 33. Likewise, for the second and third spot color, the second and third colored acrylic of color 64 and 66, respectively, is applied to the silicone master shown in FIGS. 34 and 35.

Figure 36:
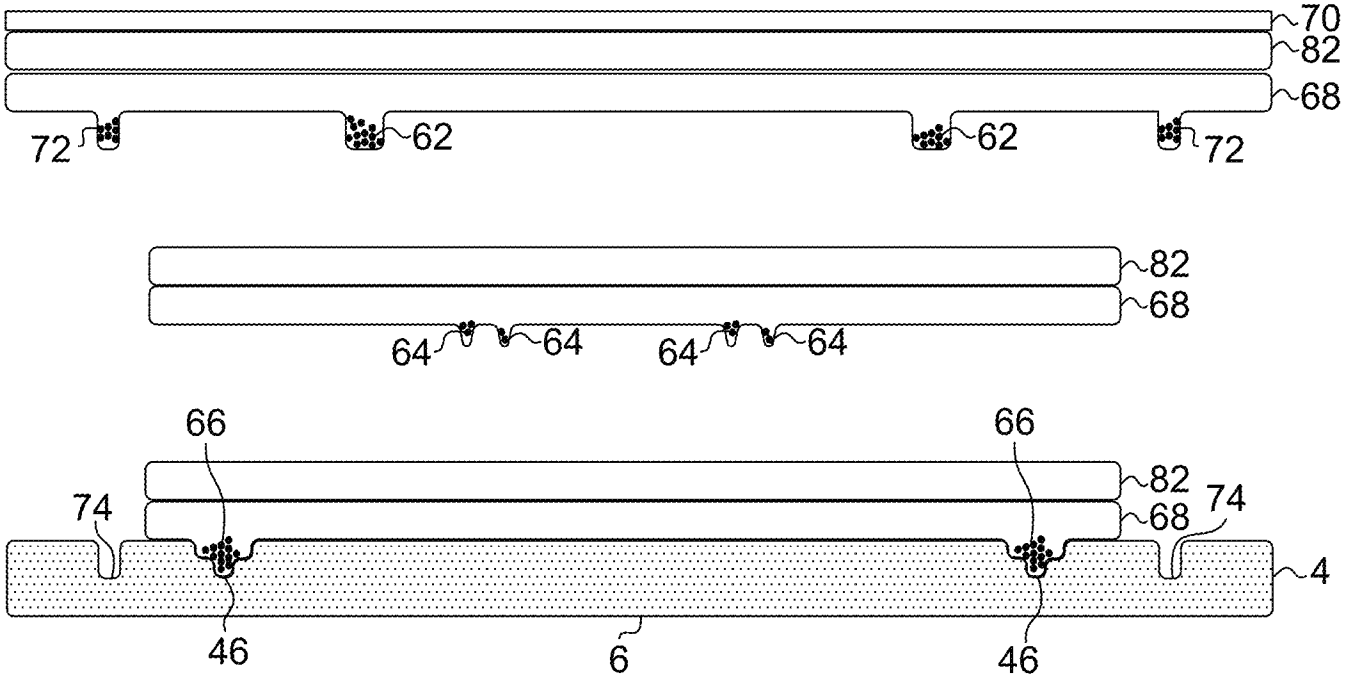
FIG. 36 depicts a process of composing an aggregate of multiple color separation layers.

FIG. 36 depicts a process of composing an aggregate of multiple color separation layers to form a single flexible template containing all three colorants 38 of different colors 62, 64, 66 and their corresponding surface features. In this example, the color separation layer 68 having the colorant of color 62 is laid down first on the carrier sheet 70. When this layer was formed from its corresponding mold, material was also laid down in receptacles 74 which form an alignment box around the spot color image area to enable registration protrusion 72 to fit into one or more subsequent color separation layers master receptacles 74 of the molds corresponding to templates having colorants of color 64 and 66. This is performed to ensure that one flexible template 6 having colorants of color 62 is properly located relative to the flexible template 6 having colorants of color 64 in a stack. Some practice getting the alignment box from spot color of one color separation layer to fit into the alignment structure on the spot color of another layer is advised. Next, an interface layer 82, e.g., acrylic gloss medium is applied (by rubbing or brushing) to the mold for template having colorants of color 64, sufficient to provide a thin layer over the entire spot color image area of the color 64 but not the alignment box. The assembly having colorants of color 62 is then applied to the color separation layer 64 using the alignment feature 74. These steps are then repeated with the color separation layer 68 having the colorants of color 66.

Figure 37:
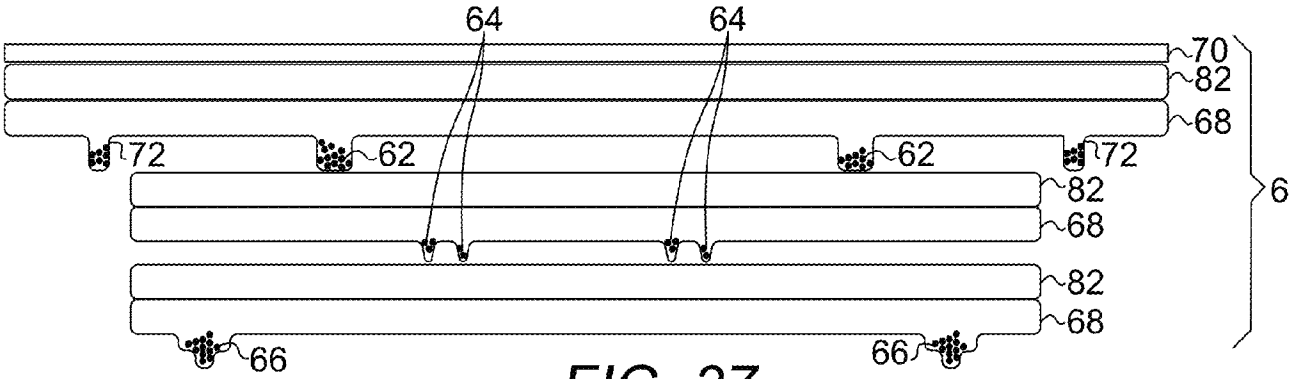
FIG. 37 depicts a composite of layers in the process of FIG. 36.

In order to provide suitable adherence, one layer is pressured or rubbed against another. In addition, some moistening of the carrier sheet 70 allows the carrier sheet 70 to better conform to the master of color 64. The carrier sheet 70 is dried with a hair dryer and the image structure (or the stack) removed. The registration protrusions 72 are used as guides to align each subsequent color separation layer 68 to a previously formed color separation assembly, i.e., a first color separation layer or its corresponding assembly that is removed from its mold is disposed over a formed-in-place second color separation layer or its corresponding assembly and registered to the mold of the second color separation layer or its corresponding assembly. A composite of layers, as an intermediate result of the process of FIG. 36 is shown in FIG. 37.

Figure 38:
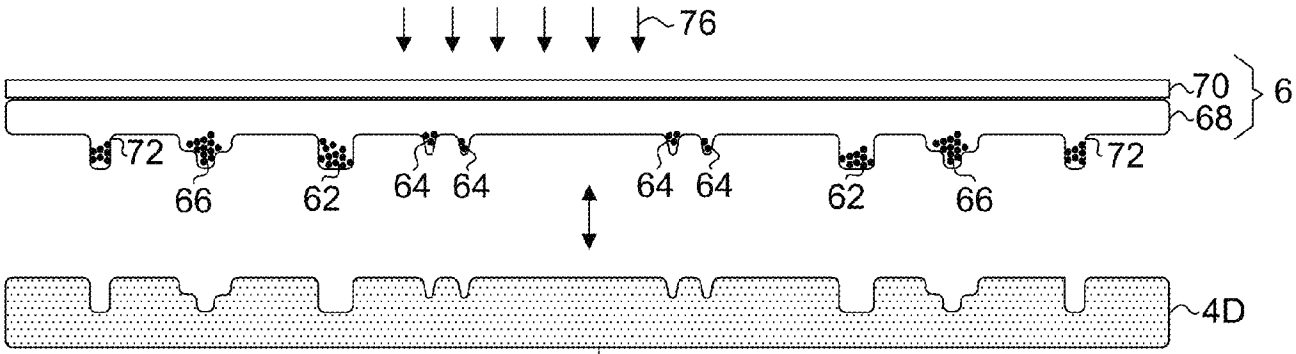
FIG. 38 depicts a final result of the process of FIG. 36.

FIG. 38 shows the final step of the process which is to fit the registration protrusion 72 into the alignment receptacle 74 on the "whole image" silicone master 4D. A household iron, on the hottest setting or about 445 degrees F., is then applied to the paper providing heat 76. In another embodiment, a minimum heat setting of 300 degrees F. is used. The heat of the iron softens the colored acrylic layers and casts them into the image structure written into the "whole image" mold 4D. The whole image mold 4D is etched deeper than the spot color molds 4A, 4B, 4C to ensure that there is ample room to cast all the acrylic, allowing the carrier sheet 70 to be brought to a flat plane on the mold 4D and each color forming a raised structure on the bottom surface of the carrier sheet 70. After cooling, the finished multicolored flexible template 6 is removed.

During application, the flexible acrylic template can be applied while the earthenware is quite wet, such as just thrown on the potter's wheel. The carrier sheet 70 will soften with moistening and can be deformed along with the earthenware with additional stretching from throwing. The flexible acrylic template is left on an earthenware item during the drying of the item, and into the bisque firing step. During drying, the earthenware item shrinks several percent, and the carrier sheet 70 may buckle and lose contact with the earthenware surface, especially if the template was applied to soft earthenware without wetting the carrier sheet 70. However, the acrylic image structure remains embedded in the earthenware, separating from the carrier sheet 70, provided the acrylic layer adhering the image structure to the paper has been kept to a minimum. It is important for the acrylic flexible template to remain embedded in the surface of the earthenware item.

Producing a Color Image Using Silicone Rubber

Figure 22:
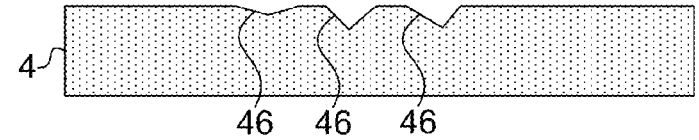
Figure 23:
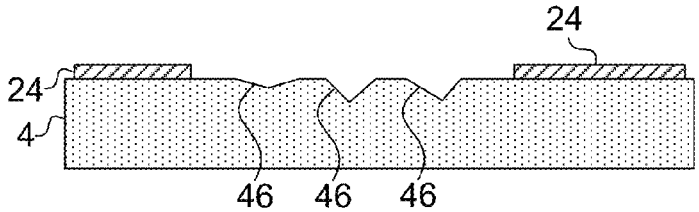
FIG. 23 is a mold upon which a shape control mask has been placed atop the mold in anticipation of the subsequent use of color separation cards.

The Applicant further discovered a technique for producing multi-color images on earthenware using silicone rubber. In order to produce a multi-color image, a separate image for each image color component is needed. The concept of using color separation cards is introduced, one for each color. A color separation card is a mask having holes or perforations corresponding to a color, e.g., red, green, blue, and through which a colorant is to be provided into indents 46 of a mold 4. Similar to the laser ablation process used to create indents in MDF, holes of a color separation card can be formed using laser ablation as well. First an image to be transferred to an earthenware item must be color separated into layers, each for a color having dots corresponding to their locations on the image. Each layer of dots is then burned onto a color separation card to form a plurality of holes 55. In one embodiment, a color separation card is constructed from paper. The mold 4 contains indents due to laser ablation where the indents correspond to dots of the sum of the color separated layers. FIG. 22 is a mold 4 where a flexible template of multi-color colorants is constructed from. In this example, the three indents 46 correspond to three different colors, one for each color. The practice of silk screen printing of colorants on ceramics is well known in the ceramics art. Although this process appears to share elements of screen printing, it will be apparent upon reading the ensuing disclosure that the present process applies to the preparation of a flexible template instead of the application of colorants through silk screens directly onto earthenware. The conventional silk screening technique involves setting up a process in a studio for screen printing, and then immediate application to earthenware. The technique is complicated and tricky and functions well only to those skilled in screen printing. FIG. 23 is a mold 4 upon which a shape control mask 24 has been placed atop the mold 4 in anticipation of the subsequent use of color separation cards 52, 53 which have been cut into the shape of the opening of the shape control mask 24. The shape control mask 24 is preferably secured to the mold 4 such that any relative movement of the shape control mask 24 and the mold 4 is avoided. A color separation card having a shape configured to conform to the opening of the shape control mask 24 is placed in the opening such that the holes 56 of the color separation card 52, 53 are aligned with the indents intended for the colorant 38 corresponding to the color separation card 52, 53.

Figure 24:
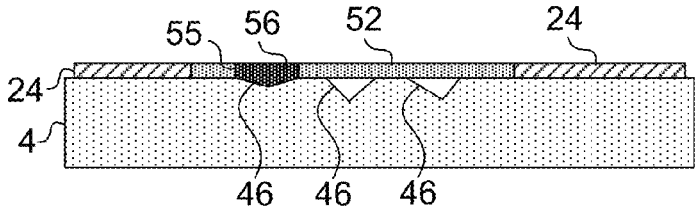
FIG. 24 depicts the use of a color separation card for laying down a first colored silicone rubber.
Figure 25:
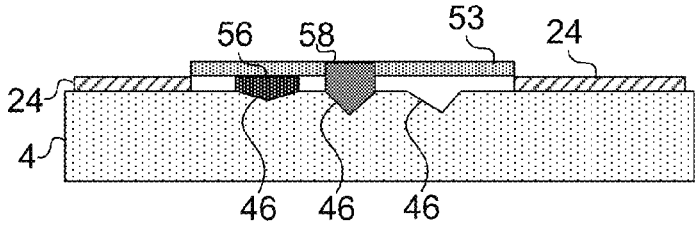
FIG. 25 depicts the use of a color separation card for laying down a second colored silicone rubber.
Figure 26:
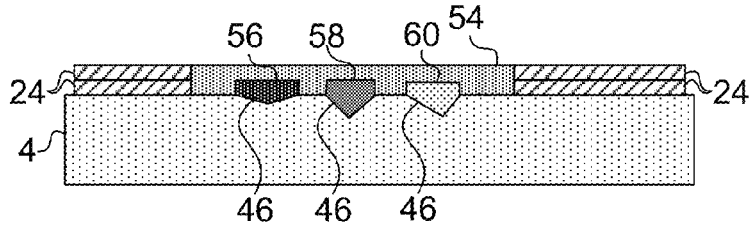
FIG. 26 depicts the result of the use of a color separation card for laying down a third colorant.

FIG. 24 depicts the use of a color separation card 52 for laying down a first colored silicone rubber 56 within the opening of the shape control mask 24. A first colored silicone rubber 56 is pressed through the first color separation card 52 into an indent 46 of the mold. It shall be noted that only one indent 46, i.e., the indent 46 destined for the first colored silicone rubber 56 is filled. Filling is accomplished by rubbing a colored silicone rubber 56 through the holes 55 into the indents 46. In one embodiment, the first separation card 52 is then removed and the first colored silicone rubber is allowed to cure before this process is repeated as shown in FIG. 25. In another embodiment, the first separation card 52 is then removed and the first colored silicone rubber is not allowed to cure before this process is repeated as shown in FIG. 25. If not allowed to cure, the second color separation card 53 will come in contact with uncured silicone rubber and crushing it when the second color separation card 53 is laid atop the first colored silicone rubber as shown in FIG. 25. FIG. 25 depicts the use of a color separation card 53 for laying down a second colored silicone rubber 58 within the opening of the shape control mask 24. It shall be noted that again, only one indent 46, i.e., the indent 46 destined for the second colored silicone rubber 58 is filled. A second colored silicone rubber 58 is used to fill the indent 46 destined for the second colored silicone rubber 58. The process of removing a used color separation card, laying down the next color separation card and filling the next colored silicone rubber is repeated for a third colored silicone rubber 60 and the result of which is shown in FIG. 26. Upon filling all indents 46 with their respective colors, a second shape control mask 24 may be added atop the first such that it provides sufficient depth for casting a backing 54. An uncolored silicone rubber is then poured onto the image area of interest and screed to be level with the second shape control mask 24 to form a backing 54. Upon curing, colored silicone rubber 56, 58, 60 becomes bonded to the backing 54 as a unity flexible template. The application of such flexible template is similar to the process disclosed for the single colorant flexible template.

In another embodiment, the construction of the mold may be staged such that the formation of indents and filling of such indents correspond to each separation of color. Upon forming a first set of indents corresponding to a color in a mold, the indents are filled with a first colored silicone rubber. The same mold is then laser ablation to form a second set of indents corresponding to a second color in the mold. The second set of indents is then filled with a second colored silicone rubber. This process is repeated for any other additional colors. A final layer of uncolored silicone rubber can be formed as backing, similar to the process in which the backing is formed in FIGS. 21 and 26.

In yet another embodiment, a clear glaze is incorporated in the uncolored silicone rubber of a flexible template such that upon bisque firing, a glaze layer will be set in place over the image formed on the earthenware.

In yet another embodiment, the mold 4 contains indents due to laser ablation where the indents correspond to dots of the sum of the color separated layers. After application of the first separation card, the same card is laser ablated to form a second set of holes for the second color, filled with color and then the process repeated for the third color.

In yet another embodiment, a carrier sheet is used to collect sets of dots which make up an image before the carrier sheet is finally applied to an earthenware item such that the image can be transferred to the earthenware item. First an original image is separated into as many color separations as is appropriate in software. Next, sheets of paper are laser ablated for each of the color separations to form sets of holes corresponding to each color separation. Then each color is applied to the carrier sheet by placing each of the laser ablated sheets on the carrier sheet and rubbing an appropriate colorant through each set of holes. The freshly applied colorant is preferably dried before the application of the next colorant via the next set of holes. The resulting carrier sheet is applied to an earthenware item and burned off, leaving the color image behind.

Applying a Colorant Directly on Earthenware

In yet another embodiment, there is provided a mask having holes through which a colorant is to be applied onto a surface of an earthenware item. Similar to the laser ablation process used to create indents in MDF, holes of such mask can be formed using laser ablation as well. The mask is laid atop the surface of a wet earthenware item, such that the mask conforms to the shape of the earthenware item. The paper is then covered with a colorant that is applied by brush causing the colorant to penetrate through the holes onto the earthenware item. When the mask burns off in the kiln, the colorant in the holes remain, forming an image which is colored and raised in the manner of an emboss. The mask may be constructed from paper or silicone rubber.

A decorative material, e.g., glaze, may be applied directly onto an earthenware item prior to the application of the flexible template. A decorative material may alternatively be applied to the image bearing surface of the flexible template prior to its application onto the earthenware item. A decorative material may also be applied to sintered earthenware. Upon application of a decorative material, the earthenware is glaze fired.

In yet another embodiment, no decorative material is applied until after an image 22 in the dish has been stained as shown in FIG. 7.

Figure 39:
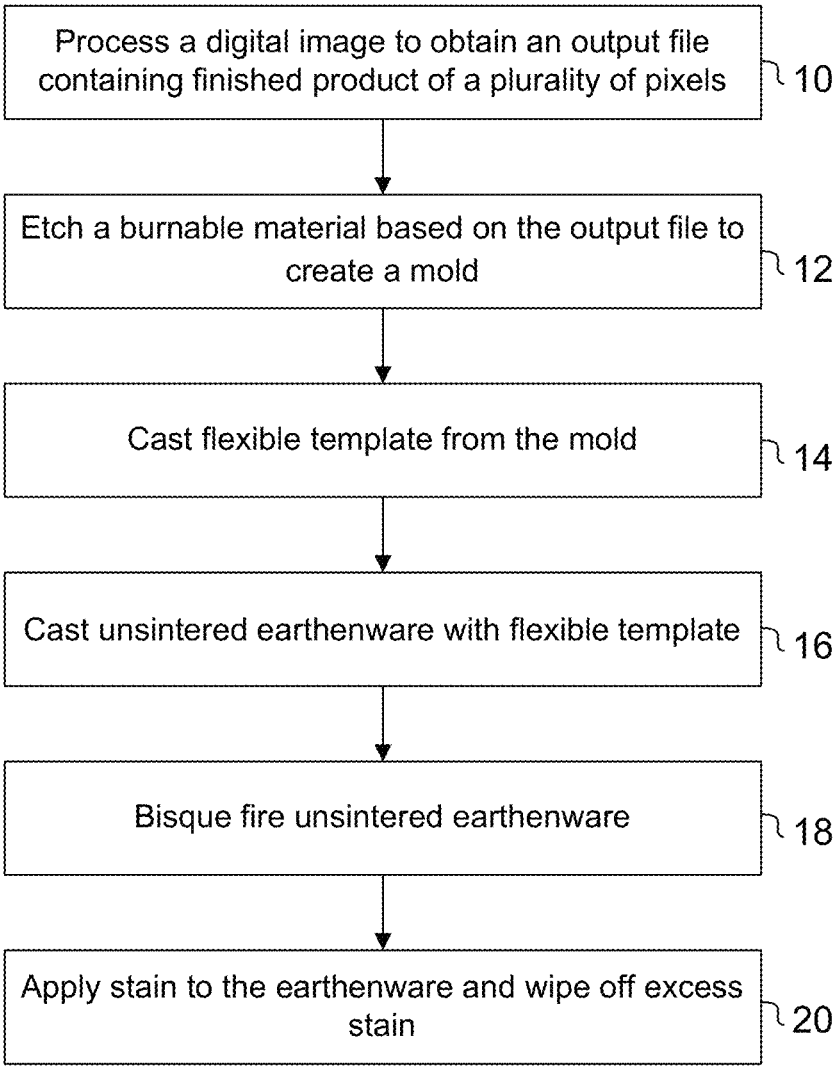
FIG. 39 is a flowchart depicting the present engraving process useful for engraving earthenware.

Summary of Earthenware Engraving Process:

FIG. 39 is a flowchart depicting the present engraving process useful for engraving earthenware. The method comprises:

(a) step 10—processing a digital image to produce an output image, wherein the output image comprises a plurality of pixels each having a gray level;

(b) step 12—etching a burnable material to create peaks and valleys corresponding to the output image to form a mold, wherein the burnable material comprises a surface roughness;

(c) step 14—casting a flexible template against the mold to obtain a mirror image of the output image in the flexible template;

(d) step 16—casting a surface of the earthenware item in an unsintered state against the flexible template to record the output image by peaks and valleys in the surface of the earthenware item;

(e) step 18—bisque firing the earthenware item in the unsintered state to render the output image permanent; and (f) step 20—applying stain to the surface of the earthenware item in the sintered state and removing excess stain from the surface of the earthenware item.

Figure 40:
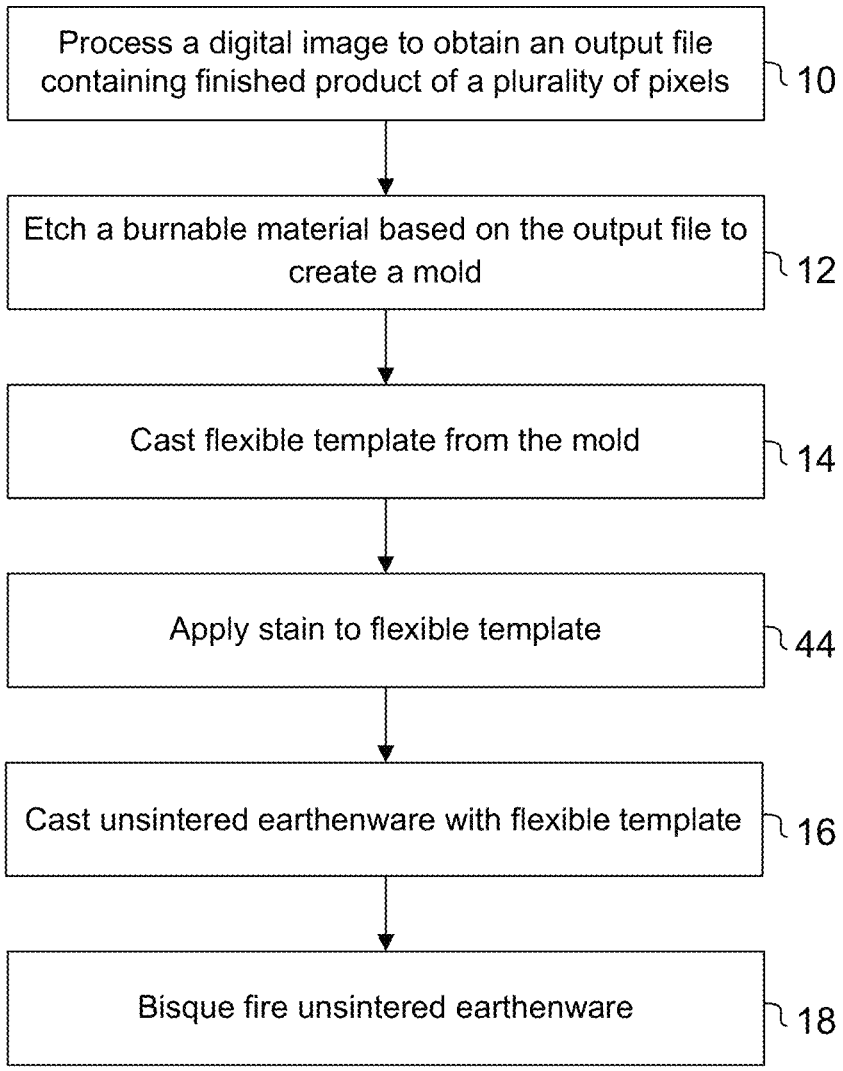
FIG. 40 is a flowchart depicting another embodiment of the present engraving process useful for engraving earthenware.

FIG. 40 is a flowchart depicting another embodiment of the present engraving process useful for engraving earthenware. The method comprises:

(a) step 10—processing a digital image to produce an output image, wherein the output image comprises a plurality of pixels each having a gray level;

(b) step 12—etching a burnable material to create peaks and valleys corresponding to the output image to form a mold, wherein the burnable material comprises a surface roughness;

(c) step 14—casting a flexible template against the mold to obtain a mirror image of the output image in the flexible template, wherein the flexible template is constructed from an incinerable material;

(d) step 44—applying stain to the mirror image of the output image in the flexible template;

(e) step 16—engaging the mirror image of the output image of the flexible template against a surface of the earthenware item in an unsintered state to record the output image by peaks and valleys in the surface of the earthenware item; and (f) step 20—bisque firing the earthenware item in the unsintered state to render a complementary image of the mirror image of the output image of the flexible template permanent.

Figure 41:
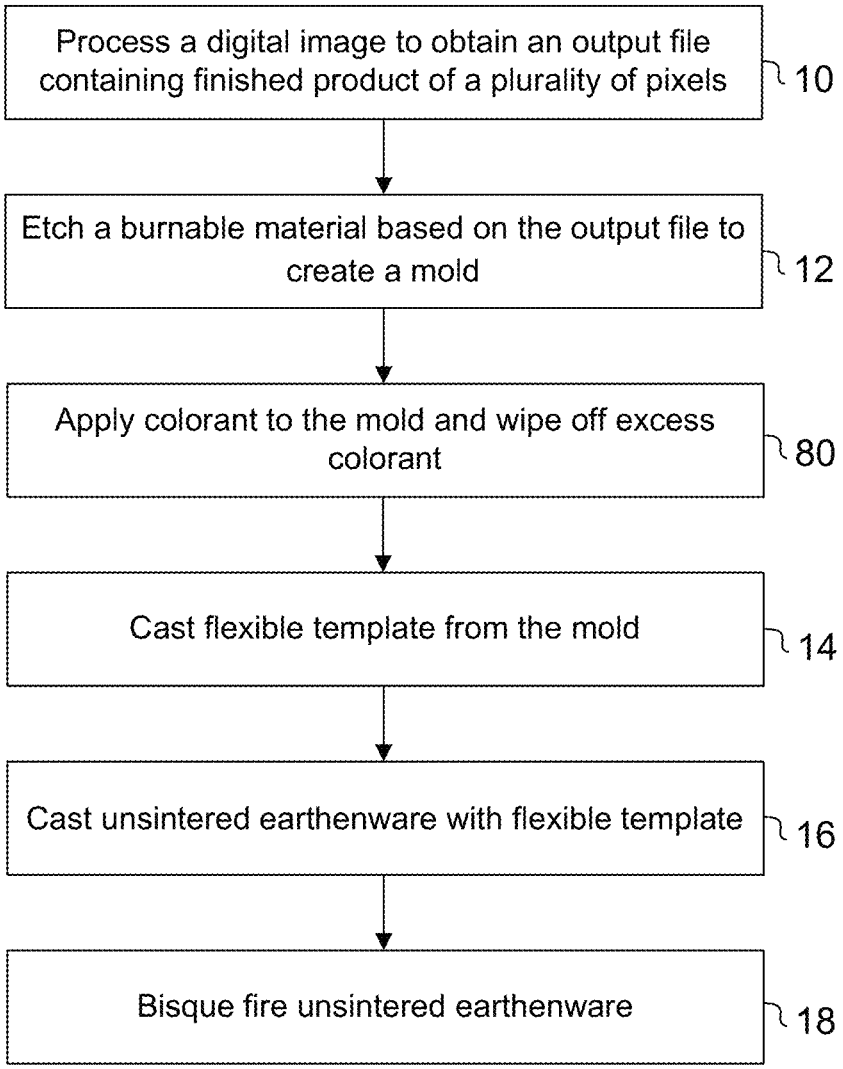
FIG. 41 is a flowchart depicting yet another embodiment of the present engraving process useful for engraving earthenware.

FIG. 41 is a flowchart depicting another embodiment of the present engraving process useful for engraving earthenware. The method comprises:

(a) step 10—processing a digital image to produce an output image, wherein the output image comprises a plurality of pixels each having a gray level;

(b) step 12—etching a burnable material to create peaks and valleys corresponding to the output image to form a mold;

(c) step 80—applying colorant to the mold and wipe off excess colorant;

(d) step 14—casting a flexible template against the mold to obtain a mirror image of the output image in the flexible template, wherein the flexible template is constructed from an incinerable material;

(e) step 16—engaging the mirror image of the output image of the flexible template against a surface of the earthenware item in an unsintered state to record the output image by peaks and valleys in the surface of the earthenware item; and (f) step 18—bisque firing the earthenware item in the unsintered state to render the output image permanent.

I claim:

1. A method for durably engraving an earthenware item, said method comprising:

(a) processing a digital image to produce an output image, wherein said output image comprises a plurality of pixels each having a gray level;

(b) etching a burnable material to create peaks, valleys and indents corresponding to said output image to form a mold, wherein said burnable material is a pressed paper fiberboard adapted to be bonded to a substrate and a surface roughness of said pressed paper fiberboard corresponds to a grit number ranging from about 120 to about 150;

(c) casting a flexible template against said mold to obtain a mirror image of said output image in said flexible template;

(d) casting a surface of the earthenware item in an unsintered state against said flexible template to record said output image by peaks and valleys in said surface of the earthenware item;

(e) bisque firing the earthenware item in the unsintered state to render said output image permanent; and (f) applying a stain to said surface of the earthenware item in the sintered state and removing excess stain from said surface of the earthenware item.

2. The method of claim 1, wherein said etching step comprises ablating said burnable material by varying the power level of a laser ablation apparatus according to the gray level of said plurality of pixels.

3. The method of claim 1, wherein said earthenware is selected from a group consisting of ceramic, stoneware, bone china and porcelains.

4. The method of claim 1, wherein said stain is an oxide.

5. The method of claim 1, wherein said output image is selected from a group consisting of line art images, halftone images and depth maps.

6. The method of claim 1, wherein said flexible template is constructed from silicone rubber.

* * * * *